United States Patent [19]

Dorsett et al.

[11] Patent Number: 4,661,213

[45] Date of Patent: Apr. 28, 1987

[54] ELECTROPLATE TO MOVING METAL

[76] Inventors: Terry E. Dorsett, 11205 Hosford Rd., Chardon, Ohio 44024; David P. Rininger, 505 Courtland St., Fairport Harbor, Ohio 44077

[21] Appl. No.: 829,283

[22] Filed: Feb. 13, 1986

[51] Int. Cl.[4] ..... C25D 5/02

[52] U.S. Cl. ..... 204/15

[58] Field of Search ..... 204/15, 28

[56] References Cited

U.S. PATENT DOCUMENTS

| | | | |
|---|---|---|---|
| 4,010,083 | 3/1977 | Bakker et al. | 204/15 |
| 4,416,756 | 11/1983 | Martin | 204/206 |
| 4,430,166 | 2/1984 | Carter | 204/15 |
| 4,441,975 | 4/1984 | Carter et al. | 204/206 |
| 4,559,123 | 12/1985 | Moore et al. | 204/206 |

FOREIGN PATENT DOCUMENTS

| | | | |
|---|---|---|---|
| 2010139 | 9/1971 | Fed. Rep. of Germany | 204/15 |
| 14091 | of 1909 | United Kingdom | 204/15 |
| 493108 | 9/1938 | United Kingdom | 204/15 |
| 760016 | 10/1956 | United Kingdom | 204/15 |

*Primary Examiner*—T. M. Tufariello

*Attorney, Agent, or Firm*—John J. Freer

[57] ABSTRACT

An anodic roller electroplating process utilizes novel anodic roller apparatus and provides flexible operation parameters. The novel anodic roller apparatus comprises a perforate valve metal cylinder such as in mesh form. The cylinder has an electrocatalytic coating and an electrolyte-containing, porous wrap. Processing parameters can provide desirable electroplate, such as of metal coils, at enhanced plating speeds as well as providing carefull control over plate composition and deposition thickness.

10 Claims, 1 Drawing Figure

ELECTROPLATE TO MOVING METAL

BACKGROUND OF THE INVENTION

It has been early appreciated that a metal substrate can be electroplated by use of a cylindrical electrode. For example in British Patent Specification No. 14,091 A.D. 1909, it is shown to plate a cathode strip outside an electrolyte tank, the strip being in contact with a rotating cylinder. The cylinder is made anodic and bears a porous, electrically nonconductive covering material that is filled with electrolyte. The rotating cylinder can have the porous covering continuously wet, as by partial immersion in a tank of electrolyte and the electrolyte can thereby wet the strip of material to be electroplated.

It may also be possible to use combination methods of applying electrolyte. Thus, for example, it has been shown in German Patent Publication No. 2,010,139 that a spray nozzle can impinge electrolyte at the zone of a roll and a moving work piece. Such roll may likewise be partially immersed in a bath of electrolyte. As also shown in this publication, the electrolyte may be internally fed to the cylinder, as by a central shaft, and then through radial tubes to wet outer porous plugs.

It has even been proposed that a central feed of electrolyte be pumped at sufficient velocity to provide for rotation of a cylindrical anode. For example, in British Patent No. 493,108 electrolyte feed from a central spindle through a vaned cavity can provide for rotation of the cylinder. The cylinder, being notched, permits for a flow of electrolyte through the cylinder to an outer porous pad covering.

It has been proposed to prepare a suitable mesh covering for an anode roll from resin such as polyethylene, polypropylene, and polymerized vinyl halides, e.g., polyvinylchloride. For example in U.S. Pat. No. 4,441,975 such mesh layers for an anode roll have been noted. The mesh layer can be snugly fit to the roll by fixedly securing the mesh thereto. Such a roll may be non-sacrificial and can be of bimetallic construction, e.g., an inner layer for strength such as of steel and an outer, electrolyte-resistant conductive layer such as of zinc.

It would nevertheless be most desirable to provide a roll plating operation having extended and efficient operation. The operation should allow for plating at high current densities, yielding a smooth and even deposit. Furthermore this should desirably be coupled with flexible processing allowing for fast application of carefully controlled electroplate composition. Flexibility could desirably include retrofitting to existing coil paint lines where, working with existing space limitations, users could switch from plating to painting with ease of changeover.

SUMMARY OF THE INVENTION

An anodic roller electroplating process has now been provided which can achieve desirable electroplate operation. This is not only achieved through a highly porous metallic anode roll itself, but also by means of its combination with desirable covering. Durability and thoroughness of operation is further combined with a highly efficient electroplating process. The process can advantageously mesh with accelerated applications, such as in fast coating lines, and obtain enhanced electroplate of carefully controlled composition and amount of deposit. Flexibility of operation can further include stripe plating as well as proportional width plating. When replacement and refurbishing is required, the present invention further provides for fast and efficient operation.

In its broadest aspect, the invention is directed to the method of metal electroplating a moving strip of metal wherein a rotating anode contacts a cathodic metal strip, which method comprises first contacting the metal strip with a cylindrical, non-sacrificial anode capable of rotational movement, the anode comprising a hollow and at least substantially perforate valve metal cylinder having an exterior surface electrocatalytic coating containing metal oxide, the anode also having a thin, highly porous outer sleeve covering of synthetic resin, with such sleeve containing metal electroplating solution. This broad method aspect of the invention continues by rotating the anode in contact with the metal strip at a rate providing relative movement between such strip and the anode, then impressing a current between the anode and cathode and electroplating such metal strip at a current density of not less than about 3,500 amperes per square foot of anode contact area.

In another aspect, the present invention is directed on the one hand to a highly porous, valve metal mesh electrode of diamond-patterned mesh, and on the other hand to a porous resin covering for such electrode and containing synthetic thermoplastic, acid-resistant homopolymer, the covering having a porosity of at least 50 percent by volume.

In a yet further aspect the invention is directed to a notched valve metal electrode cylinder having an exterior surface of electrocatalytic coating containing a precious metal oxide, as well as being directed to a valve metal key for insertion in such notch.

DESCRIPTION OF THE PREFERRED EMBODIMENTS

Figure 1:
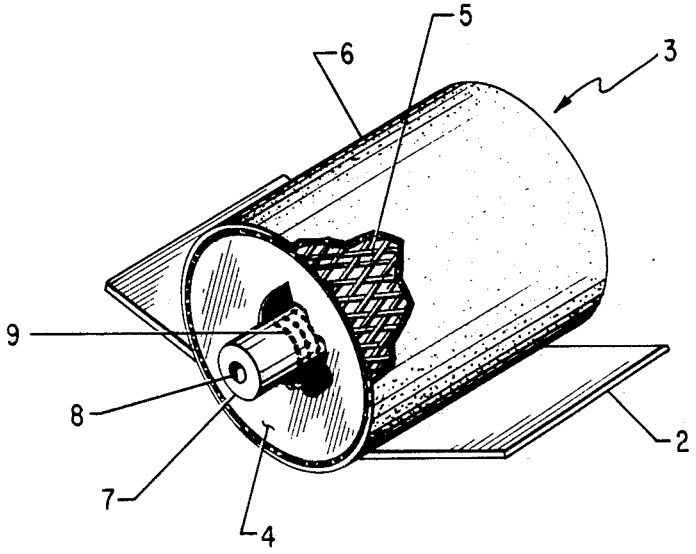
FIG. 1 depicts a cylindrical mesh electrode with porous covering, with the electrode being in contact with a work piece.

As shown in FIG. 1 a metal strip 2 moves past a coating anode shown generally at 3. The coating anode 3 rotates counterclockwise, by means not shown, and therefore contacts, tangentially, the metal strip 2 in a reverse roll manner. The coating anode 3 has disk-shaped anode end plates 4 at each end. Extending between the end plates 4 at their outer circumference is a thin, conductive hollow cylinder of metal mesh 5. The metal mesh 5 is wrapped at its outer surface by a non-conductive porous resin sleeve 6. The sleeve 6 is shown recessed from one anode end plate 4 and in partial section for purposes of illustrating the metal mesh 5.

At the center of the coating anode 3 is a central anode shaft 7 having a central axial aperture 8. Between the anode end plates 4, the anode shaft 7 is liberally perforated with a plurality of radial holes 9 extending through the anode shaft 7 to the central axial aperture 8.

In operation, as shown in FIG. 1, the metal strip 2 will move from left to right underneath the coating anode 3. The anode 3, rotating clockwise, will therefore be in tangential, reverse roll contact with the metal strip 2. In such operation, the resin sleeve 6 of the coating anode 3, being at the exterior of the coating anode 3 can provide the contact with the metal strip 2. Electrolyte, often at elevated temperature and supplied by means not shown, flows through the axial aperture 8 of the anode shaft 7 and floods out of the radial holes 9 within the coating anode 3. The anode shaft may also be used to drive the coating anode 3. The electrolyte flooding from the radial holes 9 of the anode shaft 7 readily flows past the metal mesh 5 to saturate the porous resin sleeve 6. The coating anode 3 having been made anodic, by means not shown, and the metal strip 2 cathodic, by means not shown such as a cathodic contact roll in intimate contact with the strip 2 before the anode 3, thereby provides flooded electrolyte contact between the resin sleeve 6 and the metal strip 2 and the impressed current provides for electroplating of the metal strip 2 under the anode 3. It will also be possible to include other features within the anode 3 owing to the substantial space that can be available between the anode shaft 7 and the metal mesh 5. For example, zinc metal, such as in bar form, could be affixed within this anode space. When used in zinc electroplating operation, the anode 3 will thereby serve in part as a sacrificial anode.

As the electroplated metal strip 2 leaves the area under the anode 3, forced air blowing across the strip 2 can be useful for lessening electrolyte flooding. Also, water rinsing of the metal strip 2, e.g., with tap water, after electroplating and forced air treatment, may be employed to rinse away excess electrolyte. Subsequent application of forced, heated air can be used to dry the strip 2.

The metal strip 2 can generally be in any planar, flexible form for plating such as plate or sheet form, but will most always be simply in strip form. A variety of conductive metals for the metal strip 2 are contemplated, such as nickel, iron, steel and their alloys but most typically will be steel for product economy. Prior to electroplating, the metal strip may receive pretreatment including typically any of those that are conventional in the art. The strip will most always be cleaned and may be cleaned and etched. Further, such pretreatment can include one or more heat-treating operations to anneal the strip, such as prior to cleaning or cleaning and etching.

The metal portions of the roller electrode will generally be made of corrosion-resistant metal. This would be a resistance to corrosion from the electroyte and therefore the metals will typically be resistant to acid corrosion. Acid-resistance, as well as electroconductivity, are considerations that are advantageously given to selecting the metal mesh cylinder of the electrode. This metal mesh cylinder will typically be a valve metal cylinder made of a metal such as titanium, tantalum, zirconium, tungsten, silicon, niobium, their alloys or their intermetallic mixtures. For excellent corrosion resistance and electrical conductivity coupled with economy, titanium is the metal of choice for the metal mesh.

Most typically for cylinder durability, the metal mesh will have individual mesh strands which have a width of at least about 0.2 centimeter and a thickness of also at least about 0.2 centimeter. For economy, such strand width or thickness will usually not exceed above about 1 centimeter for each dimension. Preferably, for best ruggedness of construction coupled with economy of materials, the metal mesh will be a titanium mesh having a strand width of between about 0.3–0.6 centimeter and a thickness of from about 0.6–0.9 centimeter. It can be expected that the surface area of the interconnected metal strands of the mesh will provide from about 30 to about 70 percent of the total measured surface area of the cylinder. A strand surface area of less than about 30 percent can provide for a too highly porous mesh cylinder of insufficient strength of construction. On the other hand, a surface area of greater than about 70 percent for the metal strands can act to retard best electrolyte flow from within the cylinder to the outer porous sleeve. Most usually the strands will provide between about 40–60 percent of the total measured area of the mesh cylinder.

Where the mesh has been expanded from a metal sheet, although other perforation patterns may be made, e.g., scallops or other arcuate shapes, it is most typical that the gap patterns in the mesh will be formed as diamond-shaped apertures. Such "diamond-pattern" will advantageously, for economy, feature apertures having a long way of design (LWD) within the ranges of from about 1 centimeter to about 9 centimeters, and a short way of design (SWD) within the range of from about 0.5 centimeter to about 4 centimeters. The diamond dimensions having an LWD exceeding about 9 centimeters may lead to undue strand breakage in electrode use. An SWD of less than about 0.5 centimeter, or an LWD of less than about 2 centimeters, can supply an uneconomical amount of metal to the mesh and may lead to some retardation of electrolyte flow through the cylinder.

The end plates as well as the center shaft of the roller electrode can be made with the same or similar metal as the metal mesh. Thus for economy and durability, titanium is the preferred metal for the end plates and the center shaft. The center shaft being highly perforate comprises the liquid supply means for the roller electrode. At each end of the mesh cylinder the end plates provide somewhat of a barrier so that the electrolyte flooding out from the central shaft proceeds to the mesh cylinder portion of the roller electrode. It will be understood that the roller electrode may be sectioned, e.g., to provide for ease of removal of the sleeve covering. Thus the electrode may be in two, elongated halves, but cut at an angle, whereby on disengagement and separation, the two sections can slide away from one another, thereby reducing the effective roller circumference. This will assist in ease of cover removal.

It is not necessary that the roller electrode be operated in a reverse roll coating mode. A direct roll coating mode is also suitable so long as there is relative movement between the roller electrode and the workpiece to be electroplated. In general the relative movement will be at a ratio of at least about 1.5:1, i.e., the rotational speed of the roller electrode, for example, will be at least 1.5 times the speed of the workpiece. However, such relative movement ratio might be as great as 40:1 or more, with the roller electrode usually traveling at the greater speed. Such relative movement provides an electroplate of desirable characteristics on the workpiece in a fast and economical manner. However, for best relative rate differential between the workpiece and the roller electrode, reverse roll electroplating is preferred.

To provide for the most desirable electroplate operation, the metal mesh contains an electrocatalytic coating at the outer surface of the cylinder strands. This electrochemically active coating prevents passivation of the valve metal mesh that could deter its function as an electrode. The electrochemically active coating may be provided by platinum or other platinum group metal, or it may be supplied by a number of many active oxide coatings such as magnetite, ferrite, cobalt, spinel, or mixed metal oxide coatings, which have been developed for use typically as anode coatings in the industrial electrochemical field. It is particularly preferred for extended life protection of the metal mesh that the coating be a mixed metal oxide, which can be a solid solution of a film-forming metal oxide and a platinum group metal oxide. For purposes of convenience herein, a valve metal may also be referred to as a "film-forming" metal.

Where the active coating is provided by platinum or other platinum group metal, it is understood that such metals can include palladium, rhodium, iridium, ruthenium and osmium or alloys of these metals themselves as well as with other metals. It is preferred for best electrode operation that the coating be a solid solution containing tantalum oxide and iridium oxide.

Although it is contemplated that other materials may be useful, a durable, non-conductive outer porous resin covering is used and is in snug fit around the metal mesh cylinder. It is necessary that this covering readily hold the electrolyte. For best coating efficiency, this porous sleeve should have a thickness of not substantially greater than about 1.5 centimeters. In most desirable operation, it is preferred that such sleeve be thinner, e.g., have a thickness on the order of 0.5 centimeter, or even less. The sleeve should provide a tight fit around the metal mesh for enhanced uniformity of coating operation as well as economy and durability of operation. A loose fitting sleeve can lead to undesirably excessive wear in the sleeve during operation. In general, so long as the sleeve is highly porous, it may be woven or non-woven, contain voids, or have interconnected pores, so long as electrolyte can readily flow through the sleeve. Therefore for best electrolyte flow and fast electroplate deposition, the sleeve will have a void volume of at least about 50 percent. This can be void space or porosity, so long as the porosity comprises at least substantially interconnected pores for electrolyte flow. Typically, sleeve porosity will have pore diameters within the range from about one micron to about 100 microns. For the most advantageous low voltages in operation coupled with desirable electrolyte retention capacity, the sleeve will have a void volume (porosity) of from about 50 to about 90 percent or even more, e.g., up to about 95 percent.

In typical operation the workpiece can be electroplated by a variety of electroplate metals including cobalt, copper, nickel, tin, zinc and combinations, such as nickel-zinc, zinc-iron, and including alloy and intermetallic combinations. Such electroplated metals will typically be deposited from acid electrolytes. Considering zinc electroplate as illustrative, chloride electrolytes or sulfate electrolytes may be useful, e.g., at a bath pH on the order of 3–4, or much lower for highly acidic baths. Hence the plating solutions employed may be those generally used in the electroplating field. The acidic solutions are most always contemplated and these can be used heated at elevated temperature. Thus a representative electroplating solution which has been found to be serviceable is a Watts nickel plating bath which may be heated for use at a temperature such as 140¼F.

The sleeve is a non-conductive and acid-resistant porous covering. Acid resistance, as mentioned hereinabove, will provide resistance against degradation of the covering by typical electrolyte. A synthetic thermoplastic resin covering can combine desirable snug fit for the covering over the metal mesh cylinder, coupled with covering durability in operation. For best durability and acid resistance, the preferred thermoplastic resin coverings are polyamide resin coverings, polypropylene resin coverings or blends of same.

Owing to the acidity of the electrolyte solutions, it is desirable that the roller electrode be prepared from acid-resistant materials, as has been mentioned hereinbefore. Typically, in operation, the roller electrode can be operated at from about 0.5 ampere up to about 250 amperes without deleterious materials degradation, although at low voltage, e.g., on the order of 15–20 volts, amperages of as great as 1,000 or more may be useful. Owing to the combination of the amperage permissible and the tangential contact between the roller electrode and the workpiece, electroplating will proceed at a current density of usually not substantially less than about 3,500 amperes per square foot of electrode area, (ASF), e.g., of no less than on the order of 3,300–3,400 ASF. Most typically, the current density can vary from about 4,000 up to about 6,000 ASF, although more elevated current densities, e.g., 7,000–8,000 ASF may be achieved.

It will be most typical to operate the roller electrode at a speed within the range of from about 50 to about 250 revolutions per minute, although higher speeds are contemplated. In such operation, a rapid scrubbing-type of action can be achieved during electroplating between the moving metal strip and the rotating roller electrode outer sleeve. Such high speed, rapid operation can assist in achieving the high current density plating of the present invention. In such coating operation, and referring again to zinc electroplating as illustrative, a polished, bright uniform and reflective electroplate deposit can be obtained. Such deposit, in addition to having highly desirable reflective appearance, will have further desirable coating parameters, e.g., corrosion resistance and coating adhesion.

Following the coating operation the electroplated workpiece will be suitable for further operation in typical commercial practice. For example, the workpiece may be heat treated or if in strip form can be coiled and stored for subsequent use. The workpiece may also proceed to further operation such as for additional corrosion resistance, e.g., a treatment such as etching or pickling, and subsequent coating. The subsequent coating operations can include pretreating operations such as phosphatizing and chromating, followed by painting. Thus the finished article can include a variety of products which may be painted as well as electroplated metal substrates.

The following examples show ways in which the invention has been practiced, but should not be construed as limiting the invention.

EXAMPLE 1

The cathode cylinder employed was an imperforate cathode having diamond-shaped openings. Each diamond measured 1.25 LWD×0.64 SWD centimeters (cm.). The cathode was made of titanium mesh, having a strand thickness of approximately 0.2 cm., and had an electrocatalytic coating at its exterior surface of mixed oxides of tantalum and iridium. Such catalysts have been disclosed for example in U.S. Pat. No. 3,926,751. This titanium mesh anode cylinder has a 30.5 cm. diameter.

At each end of the cylinder there are TIG welded titanium end plates. These end plates are welded to an anode shaft having a central aperture. Within the anode cylinder, the shaft contains sixteen radial holes, each 0.16 cm. diameter, so that electrolyte can be fed to the shaft through the central axial aperture and then exit the radial holes to the anode cylinder. The anode shaft also serves to provide rotational movement for the anode cylinder.

Wrapped around the titanium anode is a non-conductive and highly porous sleeve. This sleeve having a thickness of 0.8 cm., is a non-woven web consisting of polyester fiber with urethane resin. The sleeve contains a talc filler and has a porosity exceeding 90%.

For purposes of the test there was employed a four-inch wide coil of cold rolled steel that was of 20 gauge. In feeding to the coating anode, the steel strip is first passed through a cleaning section. In this section the strip is cleaned by immersion in an aqueous solution containing 4 ounces of alkaline cleaning solution per gallon of water. This solution is a commercially available material of typically relatively major weight amount of sodium hydroxide with a relatively minor weight amount of a water-softening phosphate. This cleaning bath is maintained at a temperature of about 150° F. During the cleaning operation the steel strip, all flooded with the cleaning solution, is lightly scrubbed with a roller bristle brush. As the strip proceeds from the cleaning operation it is then thoroughly rinsed with 110° F. tap water. It is thereafter dried with an air knife.

Following the cleaning, rinsing and drying the metal strip proceeds into contact with a roller steel cathode. Thereafter it is brought into contact with the roller anode.

For this test a zinc sulfate coating solution is employed. This coating bath contains 136.6 grams per liter (g/l) of zinc sulfate ($ZnSO_4.H_2O$) as well as 1.5 cubic centimeter of a concentrated non-ionic wetter. These ingredients were dissolved in deionized water. The bath was adjusted to a pH of about 3.5 using sulfuric acid. This electrolyte is maintained at room temperature and is fed at a rate of 5 liters per minute through flexible tubing to the anode shaft of the anode roll.

The anode roll is made anodic using a DC rectifier providing constant current and is rotated at 60 revolutions per minute in a clockwise direction which provides movement opposing the directional movement of the approaching steel strip. The steel strip proceeds in contact under the anode roll at a line speed of 5 feet per minute. The electroplating proceeds at a current density of 4,000 ASF of anode contact area.

As the electroplated strip emerges from the anode roll, air is blown across the strip to retard electrolyte flooding of the strip. Thereafter, tap water at room temperature is used to rinse electrolyte from the strip. Lastly, forced heated air at a temperature of about 100°–140° F. is blown down onto the strip for drying. The resulting dried strip proceeds to recoiling operation. By this operation the steel substrate receives a uniform zinc electroplate deposit of 30 grams per square meter of substrate metal. The deposit is observed by visual observation to be a smooth, even deposit along as well as across the strip.

In further testing, the strip is topcoated with DACROMET 200 corrosion resistant topcoating composition known to contain hexavalent chromium substance and particulate zinc and available from Metal Coatings International Inc. For comparative purposes, a commercially available electrogalvanized test panel is selected. The test panel is known to contain a comparable weight of zinc electroplate to the test panel prepared by the present invention. This comparative panel is likewise topcoated with a comparable coating weight of DACROMET 200 coating composition. In comparative corrosion resistance as well as coating adhesion testing, the test panel prepared by the method of the present invention is found to provide equivalent corrosion resistance and coating adhesion to the commercially available panel.

EXAMPLE 2

The coating apparatus of Example 1 was again employed. A steel strip as described in Example 1 was prepared for electroplating in the manner of Example 1. However for this test the electrolyte used was a zinc chloride plating bath containing ]02.5 g/l of zinc chloride ($ZnCl_2$). The bath also contained the minor amount of non-ionic wetter, as described in Example 1, all in deionized water, and had a pH of 3.5±0,5, as adjusted by addition of hydrochloric acid.

All in the manner as hereinbefore described in Example 1, this zinc chloride electrolyte was electroplated onto a cold rolled steel substrate. For this zinc chloride electrolyte plating a current of 250 DC amperes and 40 DC volts was used providing a current density with the range of 4,000–4,500 ASF.

Following rinsing and drying of the electroplated steel, the zinc electroplate was observed to be a bright, smooth and even deposit containing no readily visible rough or porous spots. Test panels from this electroplate were tested against comparative panels in the manner described in Example 1 and were found to provide comparable corrosion resistance and coating adhesion comparable to commercially available materials.

EXAMPLE 3

The apparatus and procedures of Example 1 were again employed except that a more highly acidic electrolyte was used. More particularly, the electroplating bath contained 136.6 g/l of zinc sulfate as well as the minor amount of non-ionic wetter, together in deionized water. Using 130 g/l of sulfuric acid, a low pH electrolyte was prepared.

During electroplating with this high acid zinc sulfate electrolyte, electroplating proceeded at 250 DC amperes and 15 DC volts providing an electroplating current density exceeding 4,000 ASF. As in Example 1, the resulting zinc electroplating was found to be a smooth and uniform deposit having a highly desirable bright finish. The electrolyte was found to deposit on a four-inch wide steel strip 26 grams of zinc electroplate per square meter of the strip.

What is claimed is:

1. The method of metal electroplating a moving strip of metal wherein a rotating anode contacts a cathodic metal strip, which method comprises:

contacting tangentially said metal strip with a cylindrical, non-sacrificial anode capable of rotational movement, said anode comprising a hollow and at least substantially perforate, valve metal cylinder having an exterior surface electrocatalytic coating containing metal oxide, said anode having a thin, non-conductive and highly porous outer sleeve covering of synthetic resin, with said sleeve containing metal electroplating solution;

rotating said anode in contact with said metal strip at a rate providing relative movement between said strip and said anode;

impressing a current between said anode and said cathode; and electroplating said metal strip at a current density of not less than about 3,500 amperes per square foot of anode area.

2. The method of claim 1 wherein said moving metal strip proceeds in tangential contact with said anode cylinder and the line speed of said strip is less than the rotational speed of said anode.

3. The method of claim 1 wherein said cylindrical anode tangentially contacts said metal strip by reverse roll coating.

4. The method of claim 1 wherein said cylindrical anode tangentially contacts said metal strip by direct roll coating.

5. The method of claim 1 wherein electrolyte feeds to said anode through a central anode shaft and thereafter travels through said perforate inner cylinder to said porous outer sleeve covering.

6. The method of claim 1 wherein a steel strip is electroplated with zinc, zinc-rion or nickel-zinc plate at a current density of at least about 4,000 ASF.

7. The method of claim 1 wherein said metal strip is contacted with a cathodic contact roll in intimate contact with said strip prior to contact with said anode.

8. The method of claim 1 wherein said metal strip following electroplating is water rinsed to remove excess solution therefrom and is subsequently dried.

9. The method of claim 1 wherein said metal strip is contacted by said anode at a relative movement differential between strip and anode within the range of from about 1.5:1 to about 40:1.

10. An electroplated metal strip produced by the process of claim 1.

* * * * *